US009022846B1

(12) United States Patent
Tom

(10) Patent No.: US 9,022,846 B1
(45) Date of Patent: May 5, 2015

(54) 110 CFM BATH FAN WITH AND WITHOUT LIGHT

(75) Inventor: Lawrence Tom, Smryna, GA (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 596 days.

(21) Appl. No.: 13/168,112

(22) Filed: Jun. 24, 2011

Related U.S. Application Data

(60) Provisional application No. 61/381,540, filed on Sep. 10, 2010.

(51) Int. Cl.
*F24F 7/06* (2006.01)
*F24F 7/007* (2006.01)

(52) U.S. Cl.
CPC ..... *F24F 7/007* (2013.01)

(58) Field of Classification Search
USPC ..... 454/213.1, 299, 277, 330, 331, 338, 454/349, 354; 411/341; 362/364, 365, 294; 415/213.1
See application file for complete search history.

(56) References Cited

U.S. PATENT DOCUMENTS

| | | | | |
|---|---|---|---|---|
| 2,950,859 | A * | 8/1960 | Kirk | 417/363 |
| 3,068,341 | A | 12/1962 | Ortiz | |
| 4,510,851 | A | 4/1985 | Sarnosky | |
| 4,526,318 | A | 7/1985 | Fleming | |
| 4,589,476 | A | 5/1986 | Berner | |
| 4,681,024 | A | 7/1987 | Ivey | |
| 4,867,640 | A | 9/1989 | Penlesky | |
| 5,934,783 | A | 8/1999 | Yoshikawa | |
| 6,261,175 | B1 | 7/2001 | Larson | |
| 6,340,237 | B1 | 1/2002 | Koga | |
| 6,488,579 | B2 | 12/2002 | Larson | |
| 6,632,006 | B1 | 10/2003 | Rippel | |
| 6,802,770 | B2 | 10/2004 | Larson | |
| 6,897,580 | B2 * | 5/2005 | White | 310/51 |
| 6,979,169 | B2 | 12/2005 | Penlesky | |
| D521,145 | S | 5/2006 | Craw | |
| 7,128,303 | B2 | 10/2006 | Penlesky | |
| 7,175,309 | B2 | 2/2007 | Craw | |
| 7,203,416 | B2 | 4/2007 | Craw | |

(Continued)

OTHER PUBLICATIONS

Tom, Lawrence, Office Action Summary mailed Nov. 7, 2014 for U.S. Appl. No. 13/289,312, filed Nov. 4, 2011, 14 pages.

(Continued)

*Primary Examiner* — Avinash Savani
*Assistant Examiner* — Vivek Shirsat
(74) *Attorney, Agent, or Firm* — Brian S. Steinberger; Law Offices of Brian S. Steinberger, P.A.

(57) ABSTRACT

Apparatus, systems and methods of 110 (one hundred ten) CFM (cubic feet per minute) generating ventilation fans for bathrooms with grill covers and with or without lights in the grill covers. Spring clip type washers can attach the grill covers to the housings. Suspension brackets directly attached to outer side walls of the housing can support the housings. One suspension bracket can be mounted on a bottom wall of the housing and another suspension bracket of equal length can be mounted on a side wall of the housing that is oriented perpendicular to the bottom wall. Bent flanges on the suspension brackets can be on opposite ends of the respective brackets. A lens cover can cover a light box that holds light sources centrally located in the grill cover. The grill cover can include vent openings that allow incoming air to bypass the light sources that can be located inside of the light box.

13 Claims, 24 Drawing Sheets

(56) References Cited

U.S. PATENT DOCUMENTS

| | | | | |
|---|---|---|---|---|
| 7,455,432 | B2 | 11/2008 | Craw | |
| 7,455,500 | B2 | 11/2008 | Penlesky | |
| 7,481,559 | B1 | 1/2009 | Rashidi | |
| 7,591,867 | B2 | 9/2009 | Choi | |
| 7,654,495 | B2 | 2/2010 | Adrian | |
| 7,677,964 | B1 | 3/2010 | Bucher | |
| 7,845,803 | B2 | 12/2010 | Lv | |
| 7,922,335 | B2 | 4/2011 | Sakai | |
| 7,993,037 | B1 * | 8/2011 | Buse | 362/365 |
| 8,104,502 | B2 | 1/2012 | Nakata | |
| D681,249 | S | 4/2013 | Tom | |
| 8,591,037 | B2 | 11/2013 | Nagumo | |
| 2008/0318515 | A1 * | 12/2008 | Yeung | 454/354 |
| 2009/0170421 | A1 * | 7/2009 | Adrian et al. | 454/349 |
| 2012/0250335 | A1 | 10/2012 | Nakano | |

OTHER PUBLICATIONS

Tom, Lawrence, Listing of pending claims for U.S. Appl. No. 13/289,312, filed Nov. 4, 2011, 7 pages.

Tom, Lawrence, Office Action Summary mailed Oct. 22, 2014 for U.S. Appl. No. 13/042,992, filed Mar. 8, 2011, 16 pages.

Tom, Lawrence, Listing of pending claims for U.S. Appl. No. 13/042,992, filed Mar. 8, 2011, 7 pages.

* cited by examiner

110 CFM BATH FAN WITH AND WITHOUT LIGHT

This invention claims the benefit of priority to U.S. Provisional Patent Application Ser. No. 61/381,540 filed Sep. 10, 2010, which is incorporated by reference in its' entirety.

FIELD OF INVENTION

This invention relates to ventilation exhaust fans, and in particular to apparatus, systems and methods of using and assembling 110 CFM ventilation fans for bathrooms with grill covers with built-in lightshades and with grill covers and no lightshades.

BACKGROUND AND PRIOR ART

Various types of bathroom ventilation fans have been proposed over the years. See for example, U.S. Pat. No. 4,867,640 to Penlesky et al.; U.S. Pat. No. 4,510,851 to Sarnosky et al.; U.S. Pat. No. 6,261,175 to Larson et al.; U.S. Pat. No. 6,488,579 to Larson et al.; U.S. Pat. No. 6,802,770 to Larson et al.; U.S. Pat. No. 7,203,416 to Craw et al.; and U.S. Pat. No. 7,654,495 to Adrian et al.

There have been many problems with the prior art. For example, many bath fans are difficult to be installed into a ceiling since the housings cannot be easily attached to different locations of joists in the ceiling. If a joist is off center to the middle of bathroom ceiling the bath fan is not easy to center in the room. Additionally, many of the bath fans have numerous parts which add extra manufacturing costs. And as a result a bath fan that requires assembly of the bath fan at a job site will incur undesirable extra labor and material costs to install. Additionally, many bath fans have to be wired to components inside of the housings which also requires extra expensive labor costs to make the connections onside during the installation of the bath fan. Thus, the need exists for solutions to the above problems with the prior art.

SUMMARY OF THE INVENTION

A primary objective of the present invention is to provide ventilation fans, apparatus, systems and methods for bathrooms with a light in the grill cover that provides 110 (one hundred ten) CFM (cubic feet of air per minute) in ventilation.

A secondary objective of the present invention is to provide ventilation fans, apparatus, systems and methods for bathrooms without a light in the grill cover that provides 110 (one hundred ten) CFM (cubic feet of air per minute) in ventilation.

A third objective the present invention is to provide ventilation fans, apparatus, systems and methods for bathrooms having flush mounted light sources with exterior perimeter grill having at least one vent opening(s) for passing air to a blower inside of the housing where the air does not pass into the light source and on any lights under the light lens cover.

A fourth objective the present invention is to provide ventilation fans, apparatus, systems and methods for bathrooms having flush mounted light sources with exterior perimeter grill having at least one vent opening(s) so that incoming air is guided around a blower fan and out the side opening and out the side exhaust opening of a housing, in order to reduce excess noise from air movement.

A fifth objective the present invention is to provide ventilation fans, apparatus, systems and methods for bathrooms having flush mounted light sources with telescoping leg(s) on at least one outer wall of a housing for the attaching the housing to joists within a ceiling.

A sixth objective the present invention is to provide ventilation fans, apparatus, systems and methods for bathrooms having flush mounted light sources having an exterior electrical box with exterior wiring box located outside of the housing.

An embodiment of the bathroom ventilation exhaust fan, can include a multi-piece housing having closed top, side walls and open bottom, a blower wheel inside of the housing, a 110 CFM generating motor partially inside of and above the blower wheel, and a flush mounted grill cover, wherein air enters into the housing through openings in the grill cover, and is exhausted therefrom by the motor run blower.

The housing can further include an outlet cover attached to a side wall outside of the housing.

The housing can include a first elongated side suspension bracket directly mounted along a bottom wall of the housing. The housing can further include a second elongated side suspension bracket directly mounted along a side wall of the housing, the side wall being perpendicular to the bottom wall, the second elongated side suspension bracket being substantially identical in length to the first elongated side suspension bracket. The first suspension bracket can have one end with a bent mounting flange, and the second suspension bracket can have one end with a bent mounting flange, wherein the bent mounting flange on the first suspension bracket faces toward one side direction of the housing, and the bent flange on the second suspension bracket faces toward an opposite side direction of the housing.

The grill cover can be without a light. Another embodiment has the grill cover with a lens cover over a light.

The grill cover can be held in place with spring loaded fasteners for attaching the grill cover to the housing, and without the use of any other fasteners. The grill is held by spring clips to attach the grill cover to the housing.

Another embodiment of the ventilation exhaust fan can include a one-piece housing having closed top, side walls and open bottom, a blower wheel inside of the housing, a 110 CMF generating motor partially inside of and above the blower wheel, a grill cover, wherein air enters into the housing through openings in the grill cover, and is exhausted therefrom by the motor run blower, a first elongated side suspension bracket directly mounted along a bottom wall of the housing, and a second elongated side suspension bracket directly mounted along a side wall of the housing, the side wall being perpendicular to the bottom wall, the second elongated side suspension bracket being substantially identical in length to the first elongated side suspension bracket.

The light can also come with a motion sensor that is built inside the housing. The motion sensor automatically controls the on/off functions of the night light.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

110 CFM Bath Fan with No Heater and with Light

A list of the components for FIGS. 1-10 will now be described.

Figure 1:
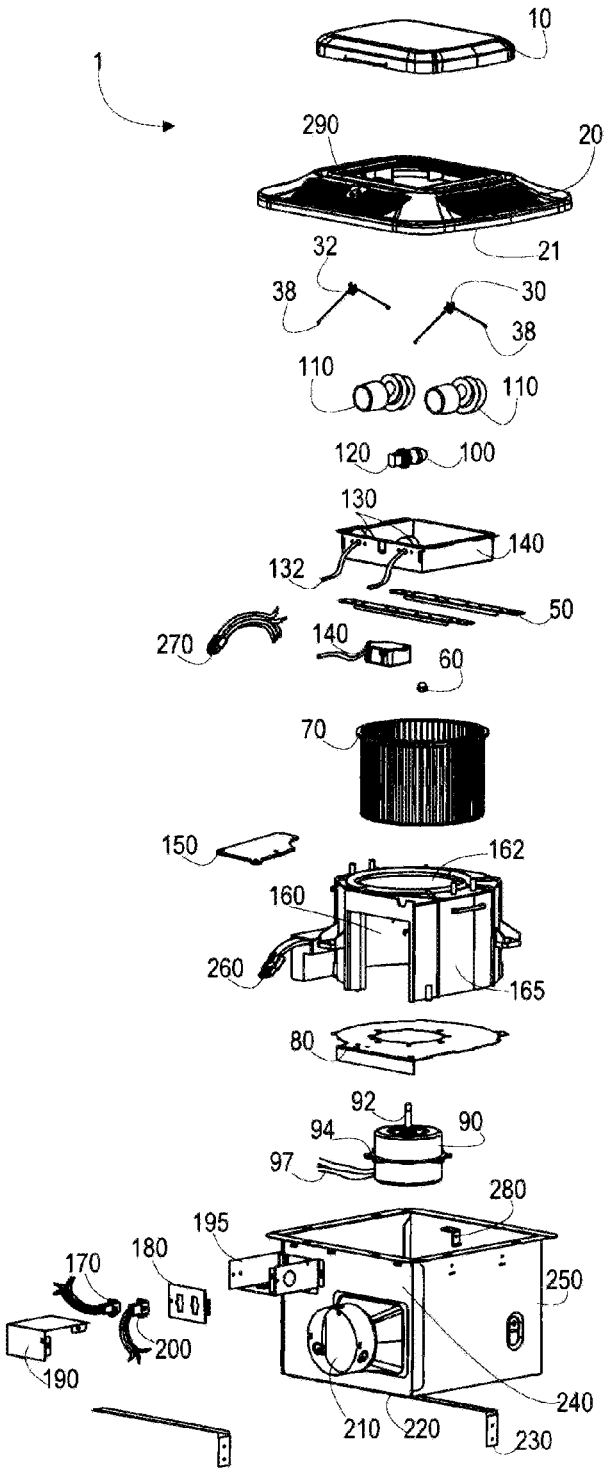
FIG. 1 is an exploded view of a 110 CFM bath fan (with no heater) and with lightshade in the grill cover (grill/lightshade cover).
Figure 2:
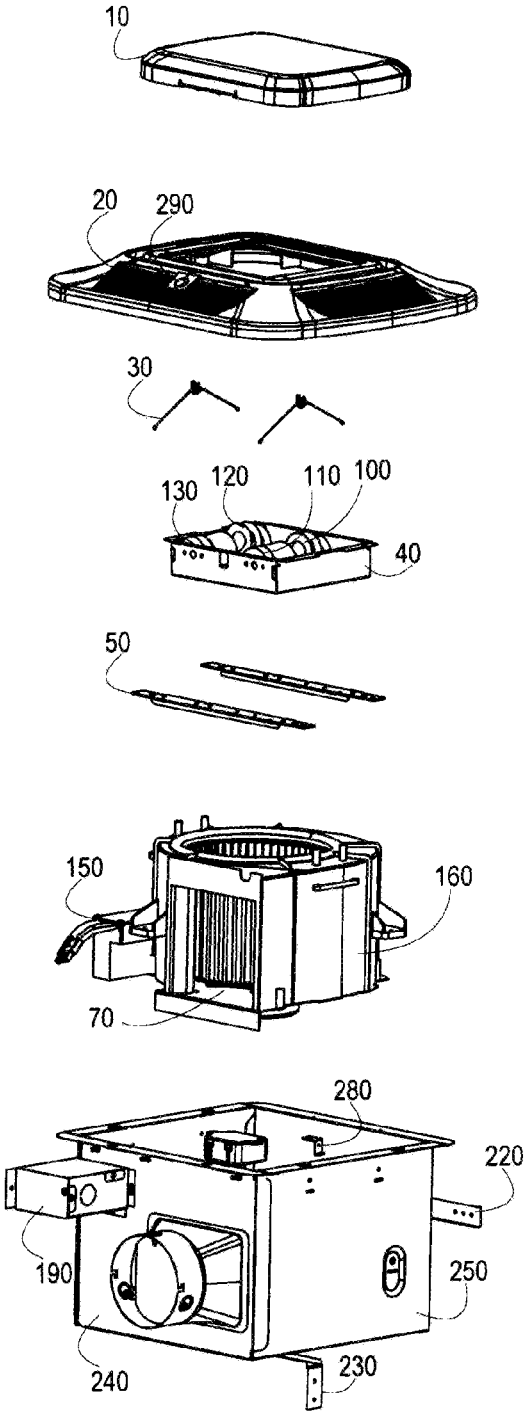
FIG. 2 is another exploded view of the bath fan of FIG. 1 with assembled blower housing and assembled light box.
Figure 3:
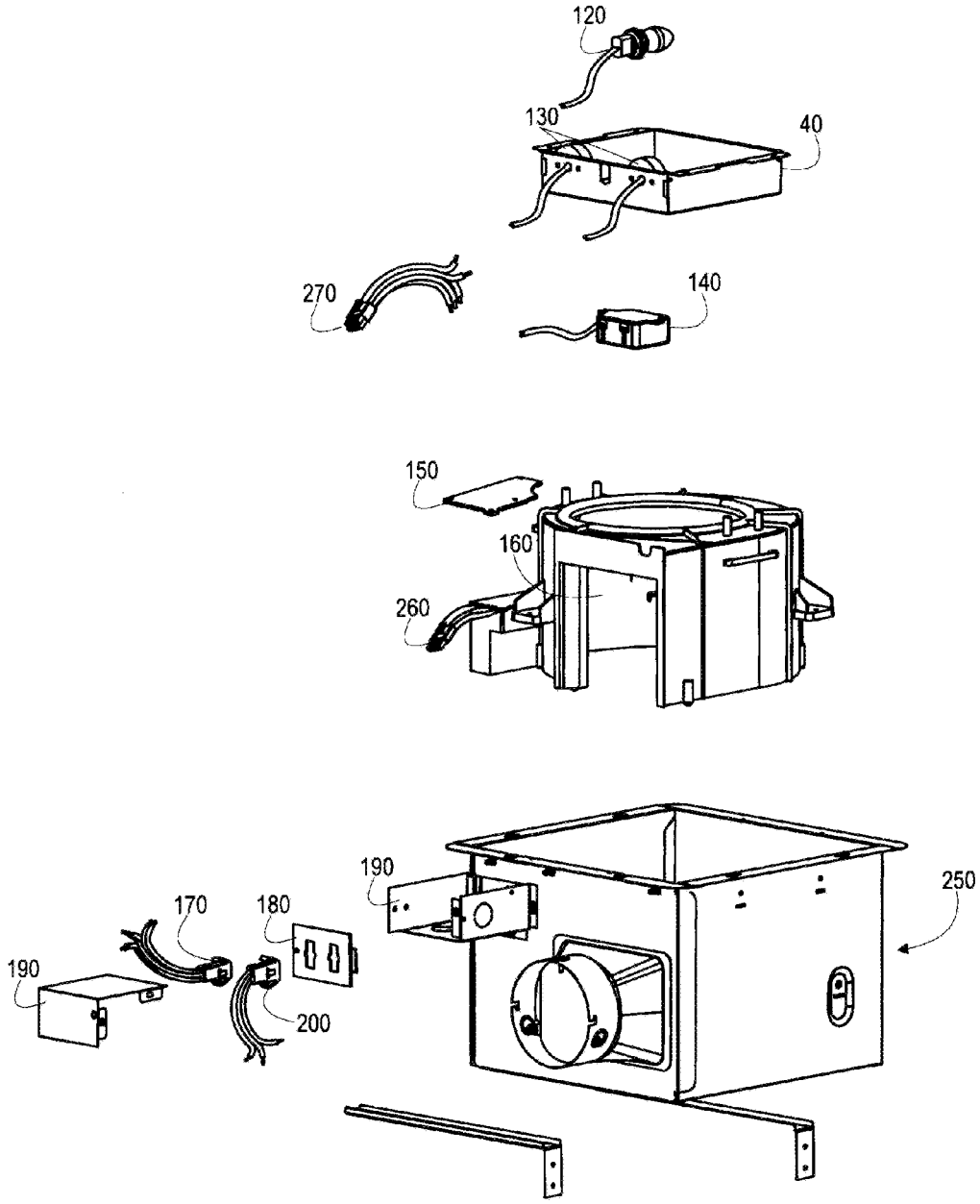
FIG. 3 is another exploded view of the bath fan of FIG. 1 with only the light box separated from blower housing and main box housing.
Figure 4:
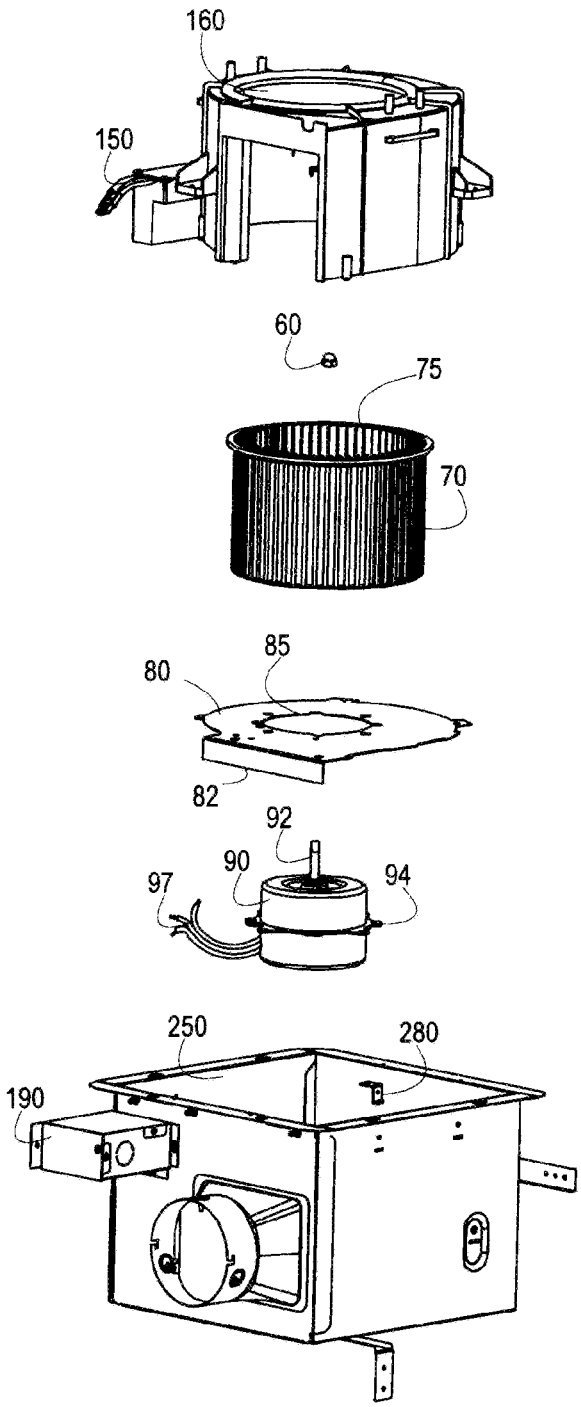
FIG. 4 is another exploded view of the bath fan of FIG. 1 with exploded blower housing components above the main housing.

1. 110 Bath Fan with No Heater and light on grill cover
10. Grill lens
20. Grill
21. perimeter edge of grill
22. grill vent
24. grill vent
25. central opening in grill
26. grill vent
28. grill vent
30. Grill clip (2)
32. Apex of grill clip
40. Light box
50. Grill bracket (2)
60. M8 Tower form nut
70. Cylindrical Blower Fan
75. Central hub for hub pin
80. Motor installation board
82. Bent side edges
85. Central opening
90. Motor
92. Hub pin
94. Raised side edges
97. Power line
100. Night light bulb
110. GU 24 Bulb (2)
120. Night Light Socket
130. GU 24 Socket (2)
140. Inductor
150. Capacitor box cover
160. Blower housing
162. Upper opening edge of housing
165. Side opening
170. Female plug 6-pin
180. Plug plate
190. Wiring box cover
200. Female plug 3-Pin
210. Damper
220. horizontal bar form extension bracket
230. T form extension bracket
240. Outlet
250. Main Housing
260. Male plug 3-Pin
270. Male plug 6-pin
280. Housing fixed iron (3)
290. Sensing probe FIG. 1 is an exploded view of a 110 CFM bath fan (with no heater) 1 and with lightshade 10 in the grill cover (grill/lightshade cover) 10. FIG. 2 is another exploded view of the bath fan 1 of FIG. 1 with assembled blower housing 160 and assembled light box 40. FIG. 3 is another exploded view of the bath fan 1 of FIG. 1 with only the light box 40 separated from blower housing and main box housing. FIG. 4 is another exploded view of the bath fan 1 of FIG. 1 with exploded blower housing 160 with components 80, 90 above the main housing.

Referring to FIGS. 1-4, the novel bath fan can include a one piece main housing 250 with four closed sidewalls and an open top and open bottom, a motor installation board 80 having a bent side edge flange 82 that can be attached to an lower inner sidewall of the housing 250, by common fasteners, such as but not limited to screws, bolts, rivets, welding, and the like. The board 80 allows for the lower side edges of blower housing 160 to sit thereon and connect thereto, by similar fasteners, and the like. Inside the blower housing 160 can be a cylindrical blower wheel 70 having side fins about the perimeter. The motor 90 can have raised side edges 94 that allow the motor to rest over the opening 85 in the motor board 80, and stay fixed by similar fasteners. An electric motor 90 having a rotatable hub pin 92 that can attach to a central hub 75 inside of the blower wheel 70, so that rotating the hub pin 92 causes the blower wheel 70 to rotate, with a tower nut 60 helping to hold the components in place. Rotating the blower wheel 70 allows for the side fins to draw air into the blower housing 160, and to be exhausted from side opening 165 to pass through damper 210 having a pivotal flap.

Power for the electric motor 90 can be supplied through a power line 97 that attaches to a male plug 260 that feeds to an external wire box 195 having a wire box cover 190 located outside of the main housing 250. Male plug 260 can be attached to a mateable female plug 200 through an opening in a plug plate 180. The plug plate 180 can be accessible by removing the box cover 190. The female plug 200 can receive power from a household power supply. A capacitor box cover 150 can be removed to access the wiring 260 (this comes from the factory pre-wired, so not sure if we need to include this statement) and be located on the blower wheel housing 165.

Across the upper opening of the main housing 250 can be a pair of grill brackets 50 having ends that are attached to upper edges of the main housing by common fasteners, previously described. The main housing 250 can be a one piece pre-formed housing. The grill brackets 50 hold the blower housing 160 in side of the main housing 250 and allow for a surface to support the bottom of a light box 40. The light box 40 can have a closed bottom, four generally closed sidewalls and open top. The light box 40 can be attached to the grill brackets 50 by common fasteners, previously described, with an inductor 140 located underneath. The light box 40 can be generally sealed so that incoming air into the fan is not able to pass into the light box 40.

Inside of the light box 40 can be a pair of sockets 130 that allow for a like pair of bulbs 110 to be attached thereto. Additionally, inside of the light box 40 can be a night light socket 120 for holding a night light bulb 100 thereto. Power for the bulbs 100, 110 can be supplied by wires 132 that attach to a male plug 270, the latter of which can be positioned into the external wire box 195 through another opening in the plug plate 180. The male plug 270 can mateably interconnect with a female plug 170, that receives power from a building power supply.

Covering the upper opening of the main housing 250 can be a grill cover 20 that can have a central opening for allowing the bulbs 100, 110 to pass light out of, with a grill lens 10 covering the main opening in the grill cover 20.

A pair of grill clips 30 can springably hold the grill cover 20 to the blower housing 160. The pair of grill clips 30 can each be scissor clips each having an apex 32 that can attach to an inner protruding portion along the lower edge 21 of the grill cover 20. The cover 20 can be attached by pressing together the legs 38 of the clips 30, so that the legs 38 can be inserted to catch inside the upper edge 162 of the blower housing 160. There can be a rectangular flap that allows the spring clips 30 to sit inside the blower housing 160 and held in place once the clips 30 are in the open position.

The clips 30 hold the grill 20 cover in place relative to the main housing 250. The light passing lens cover 10 can attach to the grill cover 20 by different fastening techniques such as but not limited to using snap edges, male and female connection points, and fasteners, such as but not limited to screws, and the like.

Figure 5A:
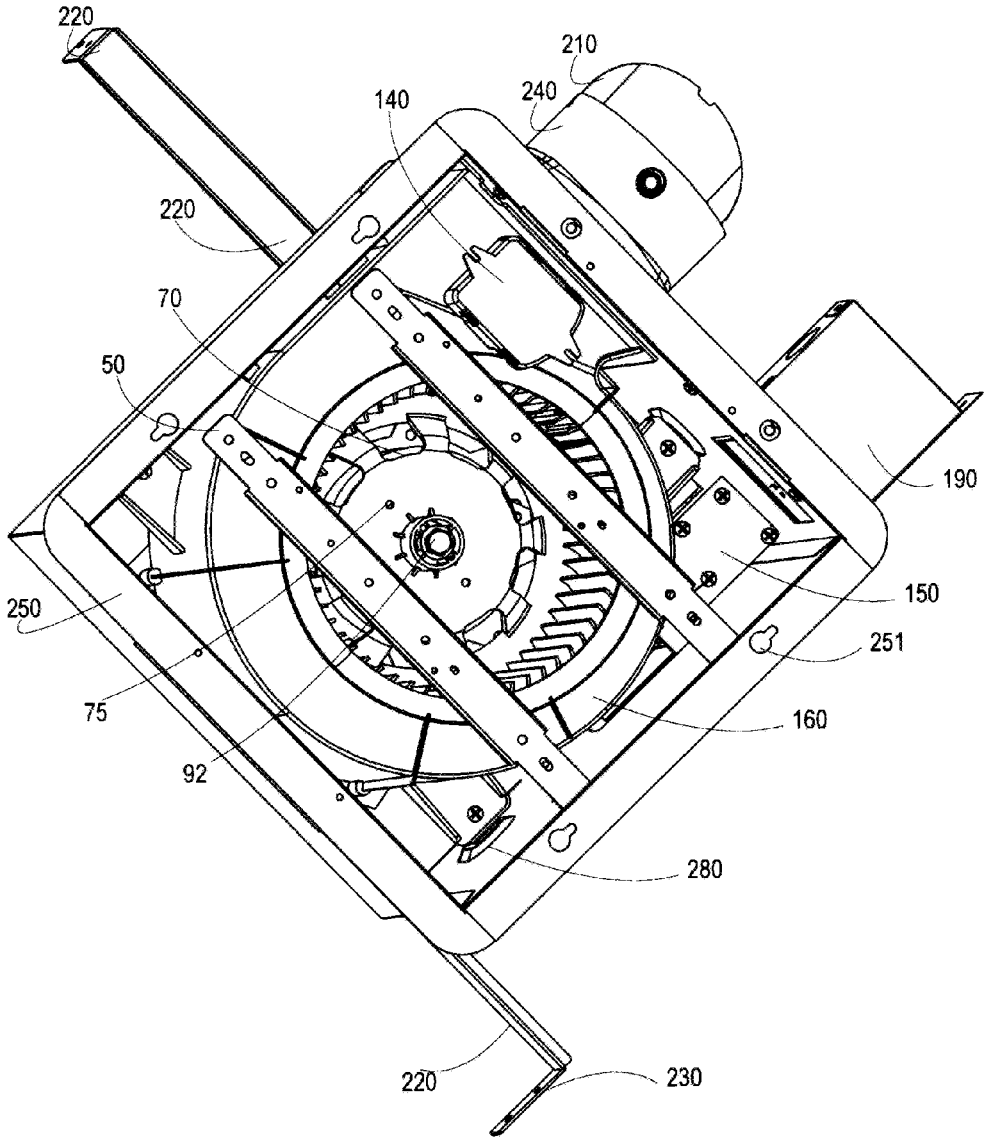
FIG. 5A is a perspective upper view of the bath fan of FIG. 1 with main housing assembled with the blower housing components without the light box and grill/lightshade cover.
Figure 5B:
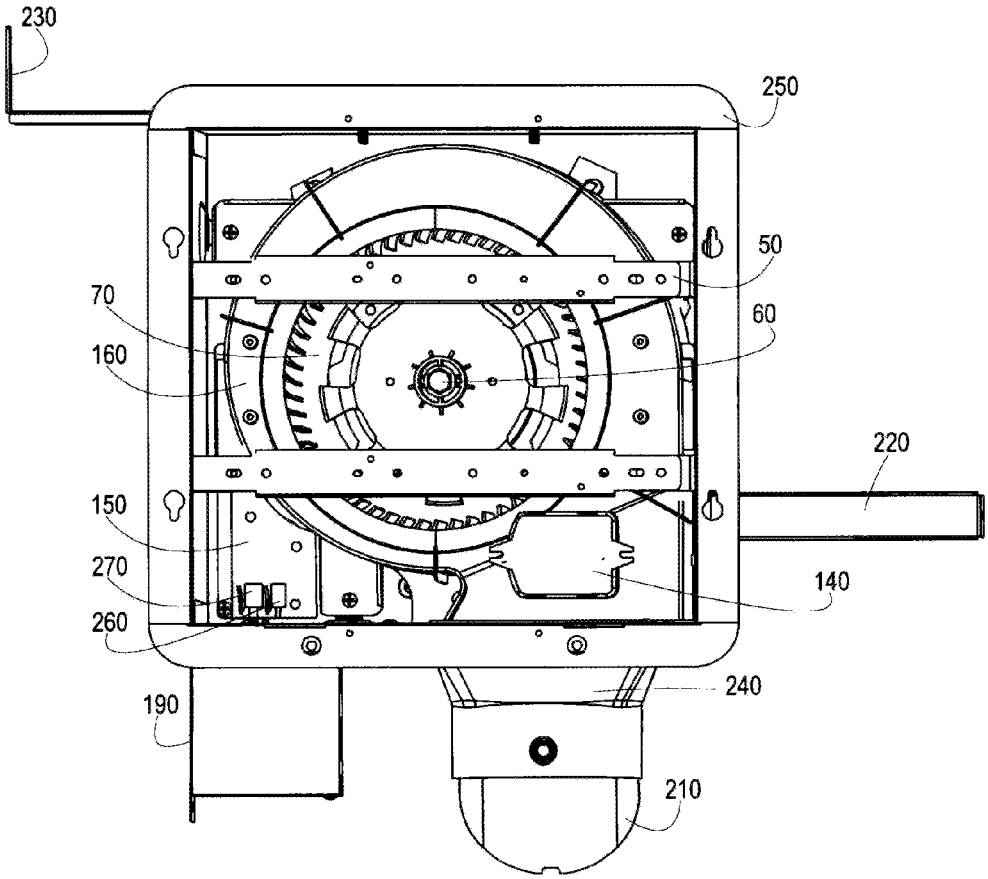
FIG. 5B is another upper view of the bath fan of FIG. 5 with assembled blower housing components inside the main housing without the light box and grill/lightshade cover.

FIG. 5A is a perspective upper view of the bath fan 1 of FIG. 1 with main housing 250 assembled with the blower housing 160 and its' components without the light box and grill/lightshade cover. FIG. 5B is another upper view of the bath fan of FIG. 5 with assembled blower housing 160 and its' components inside the main housing 250 without the light box and grill/lightshade cover.

The keyhole slots 251 lets the user install the screws in position first and then the circular part of the keyhole lines up to the screw head and you can slide the bath fan housing forward so the screw head is over the narrow part of the keyhole slot. After it is in place you fasten the screws and it holds the housing in place. This is another method to install the bath fan if you cannot install via the suspension brackets 220, 230 and joists 410 (shown in FIG. 20). Basically, screws (not shown) can be attached to a ceiling, and the housing 250 can be attached directly to the screws.

Figure 6A:
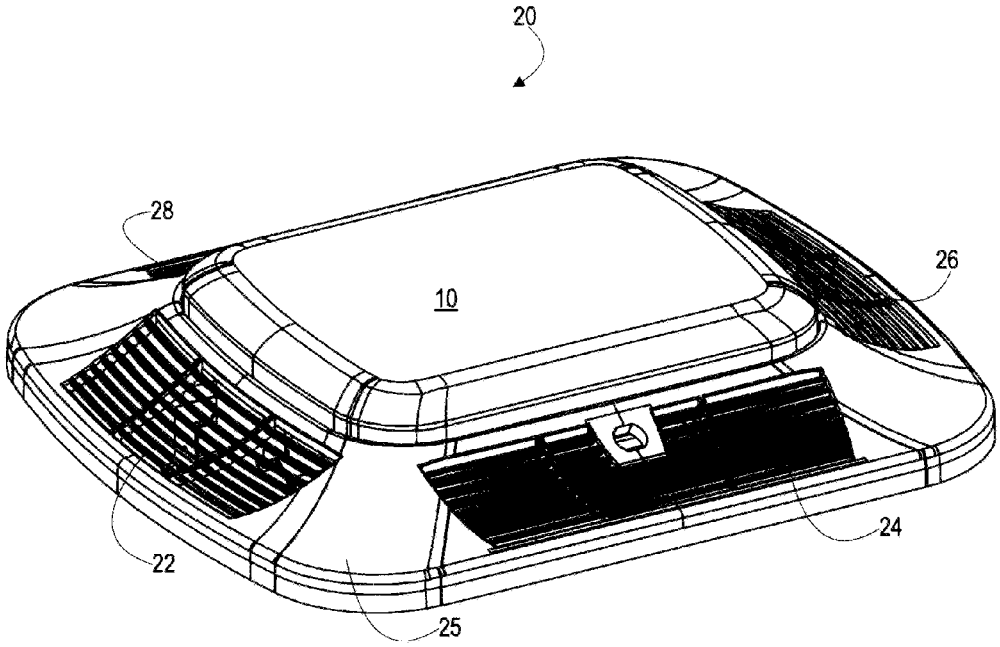
FIG. 6A is a perspective view of the grill/lightshade cover for the bath fan of FIG. 1.
Figure 6B:
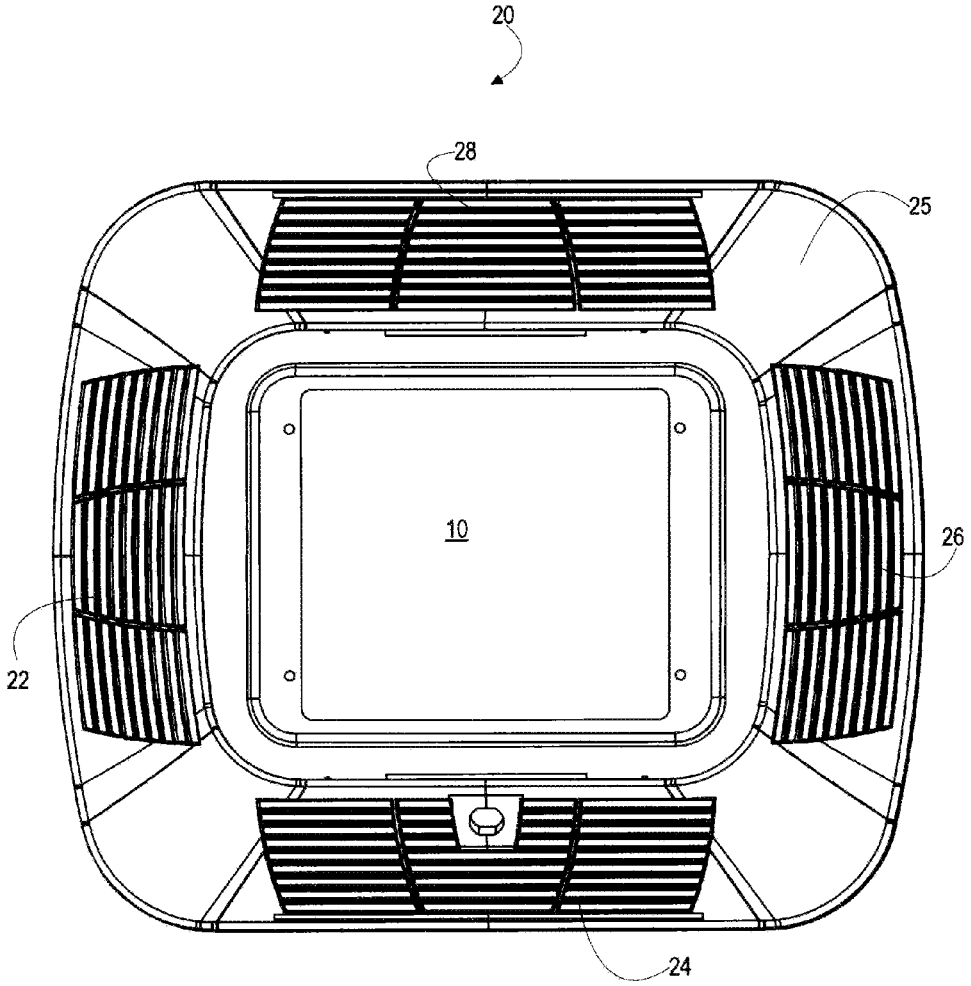
FIG. 6B is a top view of the grill/lightshade cover of FIG. 6A.

FIG. 6A is a perspective view of the rectangular grill/lightshade cover 20 for the bath fan of FIG. 1. FIG. 6B is a top view of the grill/lightshade cover 20 of FIG. 6A. The grill cover can have a four vents 22, 24, 26, 28 about a perimeter upper surface, a central opening 25 that is covered by the grill lens 10.

Figure 7:
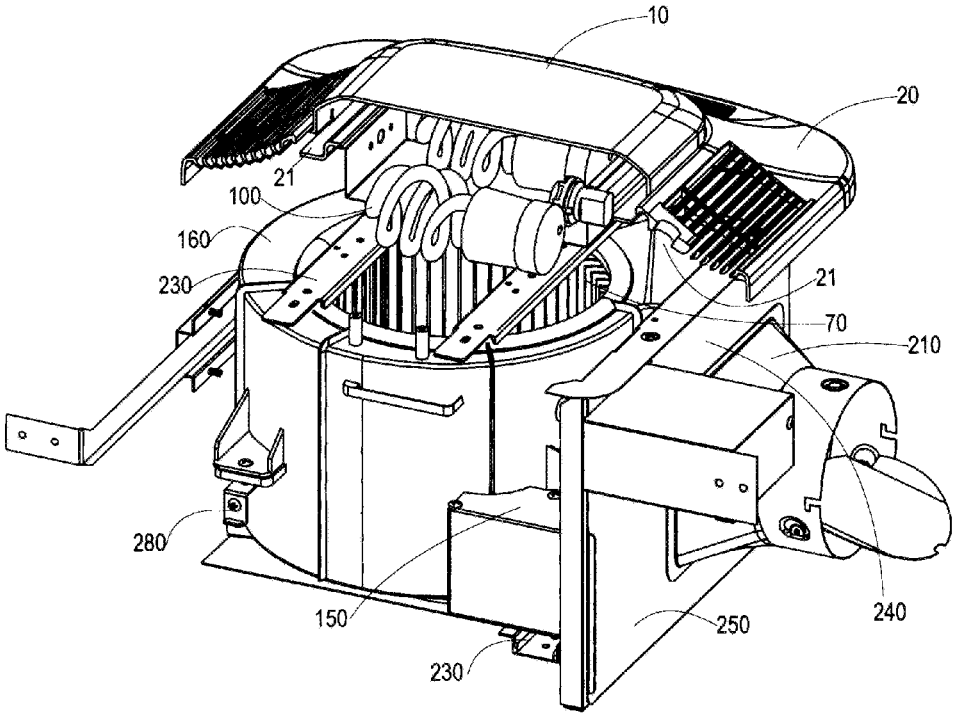
FIG. 7 is a partial perspective view of a cut-away portion of the grill/lightshade cover on the bath fan of FIG. 5A.

FIG. 7 is a partial perspective view of a cut-away portion of the grill/lightshade cover 20 on the bath fan housing 250 of FIG. 5A. Component 21 points to the hole where the motion sensor would be. Since it is a cross-sectional view the drawing only shows half of the circle.

Figure 8:
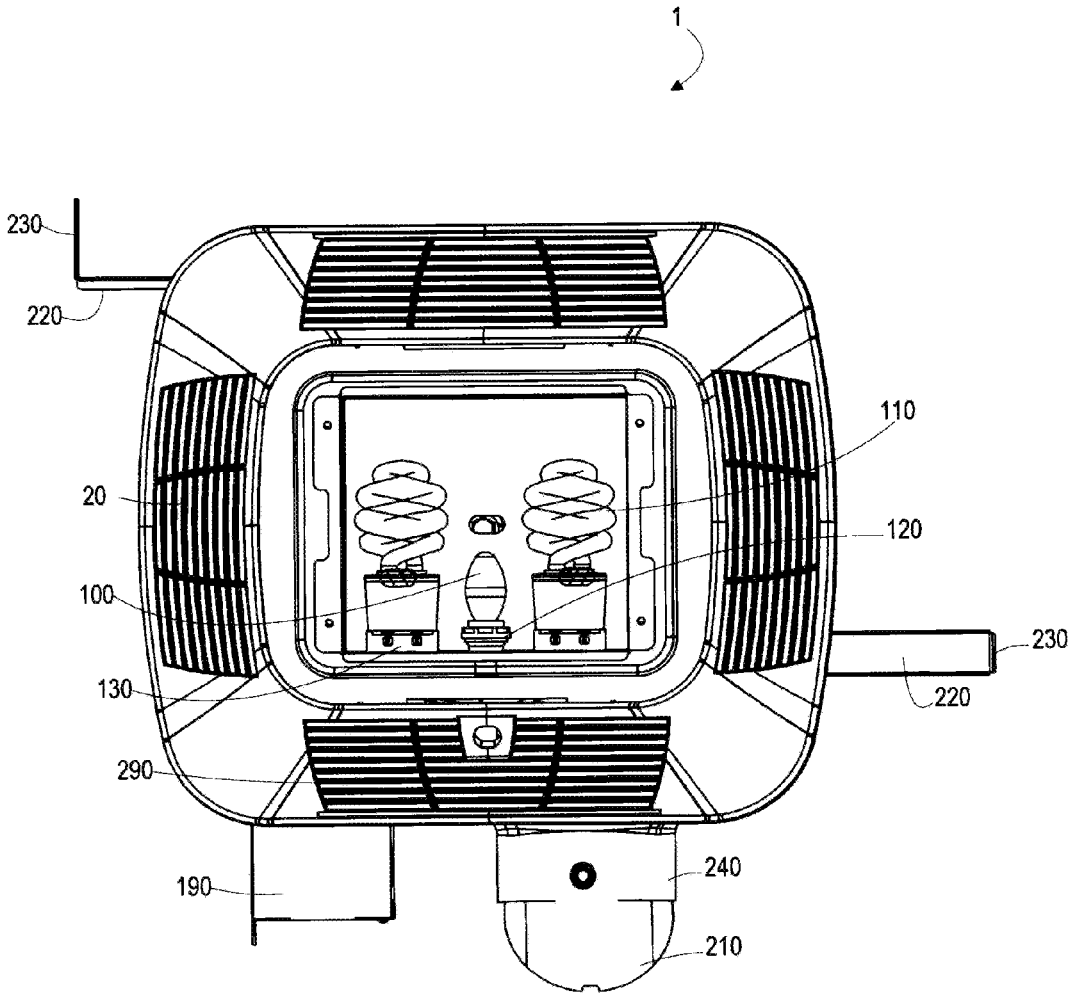
FIG. 8 is a top view of the bath fan of FIG. 7 with grill cover, and lightshade removed.
Figure 9A:
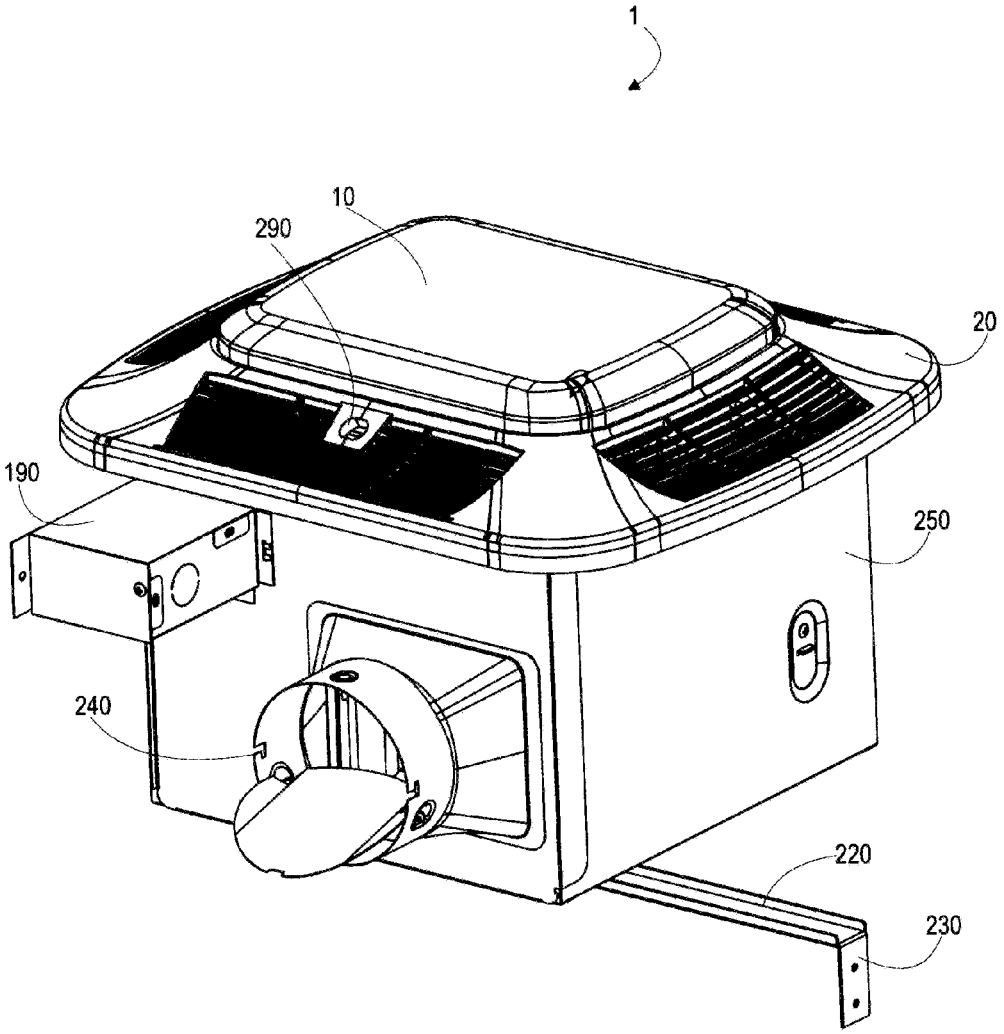
FIG. 9A is a perspective side view of the assembled bath fan of FIG. 8 with grill/light shade cover fully installed.
Figure 9B:
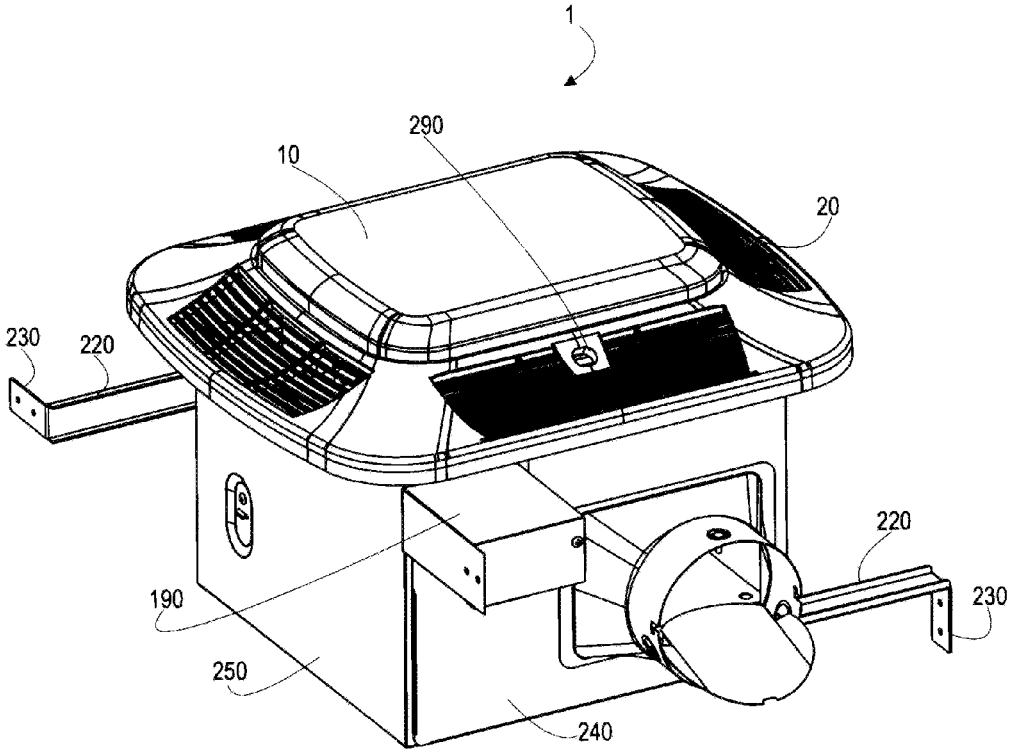
FIG. 9B is another perspective side view of the assembled bath fan of FIG. 8 with grill/light shade cover fully installed.
Figure 10:
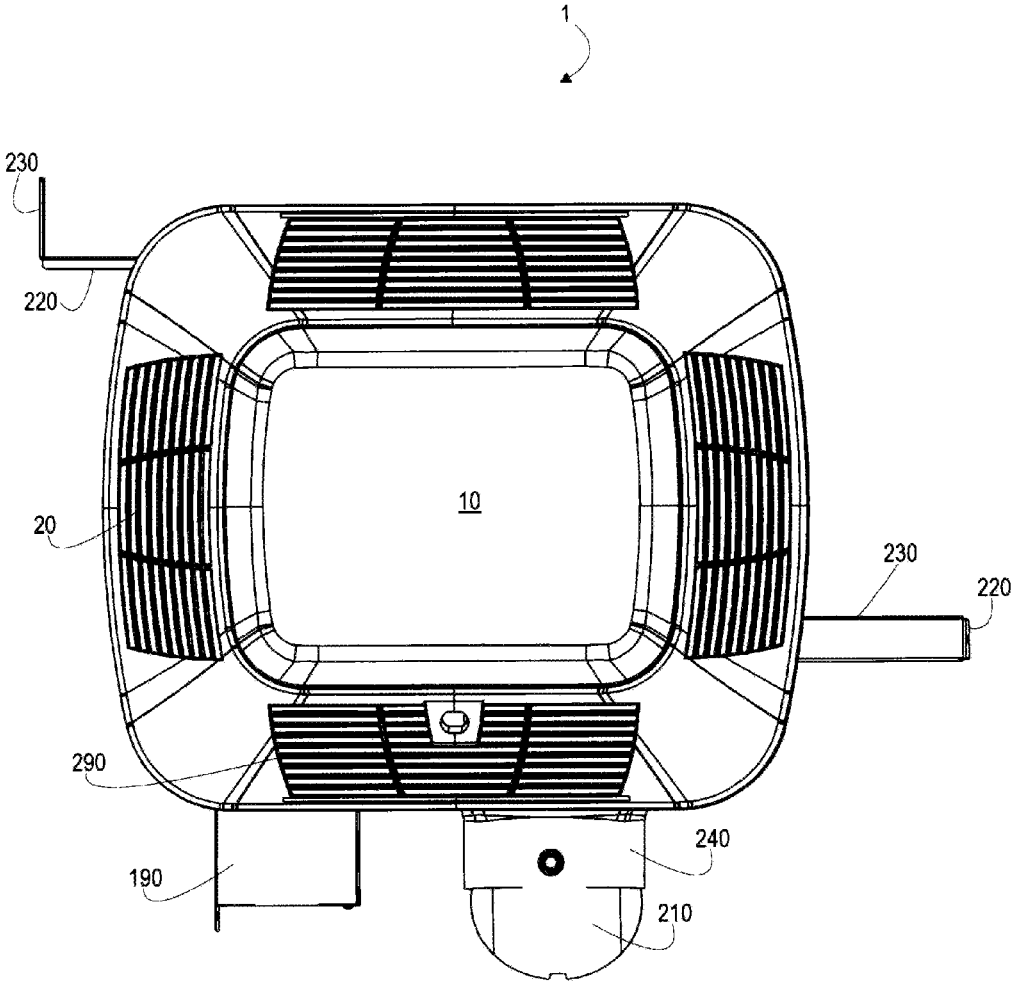
FIG. 10 is a top view of the assembled bath fan of FIGS. 9A-9B.

FIG. 8 is atop view of the bath fan 1 of FIG. 7 with grill cover 20, and lightshade lens 10 removed. FIG. 9A is a perspective side view of the assembled bath fan 1 of FIG. 8 with grill/light shade cover lens 10 fully installed. FIG. 9B is another perspective side view of the assembled bath fan 1 of FIG. 8 with grill/light shade cover fully installed. FIG. 10 is a top view of the assembled bath fan 1 of FIGS. 9A-9B.

Referring to FIGS. 8-10, the assembled bath fan 1 can be attached to joists (not shown) in a ceiling by a pair of horizontal bar form extension brackets 220, each being fastened to one side of the housing 250 and another fastened on a bottom of the housing 250, with each having a T-form extension bracket 230. The T-form extension bracket 230 can slide relative to the horizontal brackets 220. The suspension brackets can include a telescoping portion, where one portion is fixed to the side and bottom of the housing 250 and the other portion can slide relative to the fixed bracket portion.

Up to 3 housing fixed iron members 280 can be used which allow the blower wheel housing 160 to be secured to the bath fan housing 250 with a fastener, such as but not limited to a screw, and the like.

On the grill cover 20 can be a sensing probe 290 such as a motion sensor. When activated by an occupant beneath the fan 1, the motion sensor 290 can be used to activate the lights. Additionally, the motion sensor 290 can be connected to run the blower fan when an occupant is detected by the sensor 290.

110 CFM Bath Fan with No Heater and with Grill and No Light

In addition to the previous numbered, component, the additional list of the components for FIGS. 11-20 will now be described.

299. Bath Fan with Grill Cover and No Light
300. Grill cover
400. Ceiling
410. Joist(s)

Figure 11:
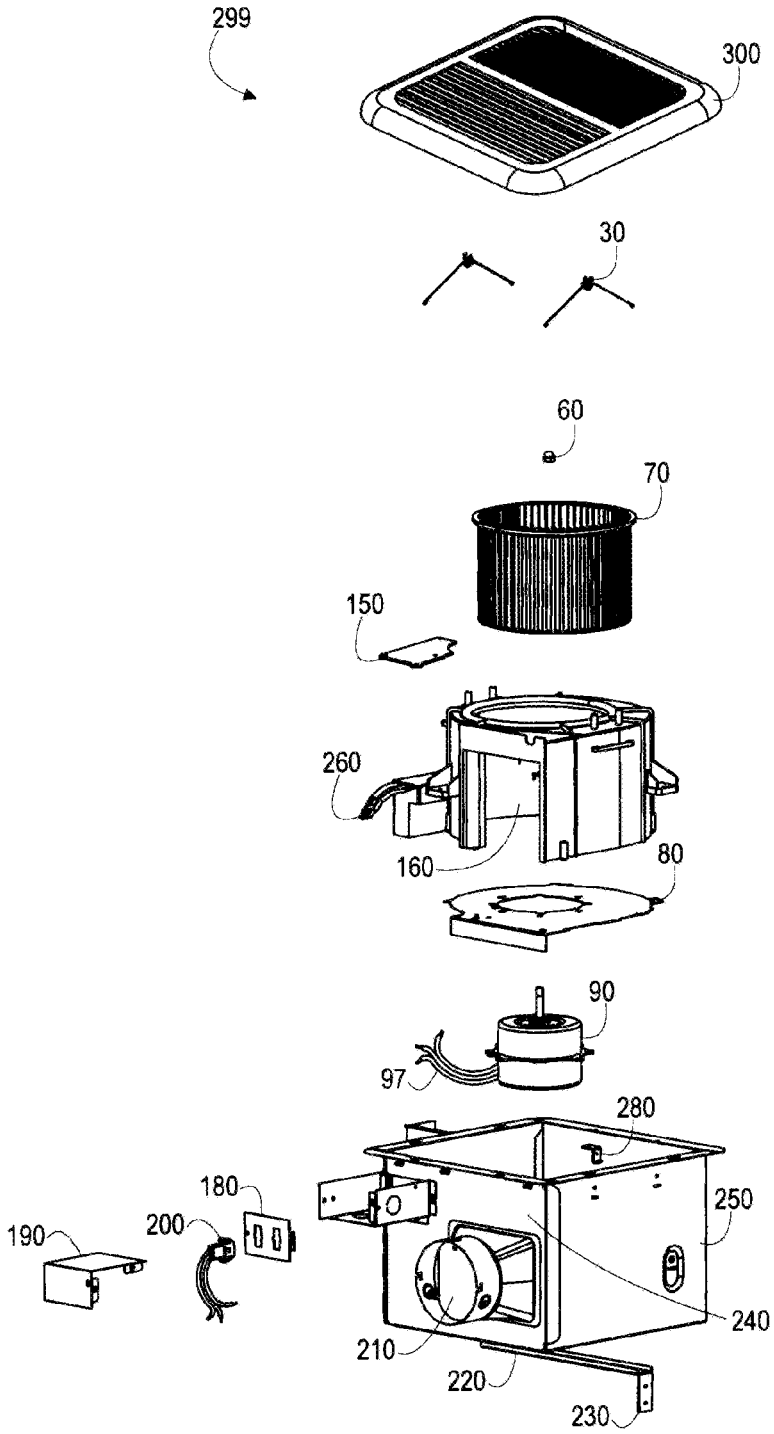
FIG. 11 is an exploded view of another 110 CFM bath fan (with no heater) and with a grill cover having no lightshade.
Figure 12:
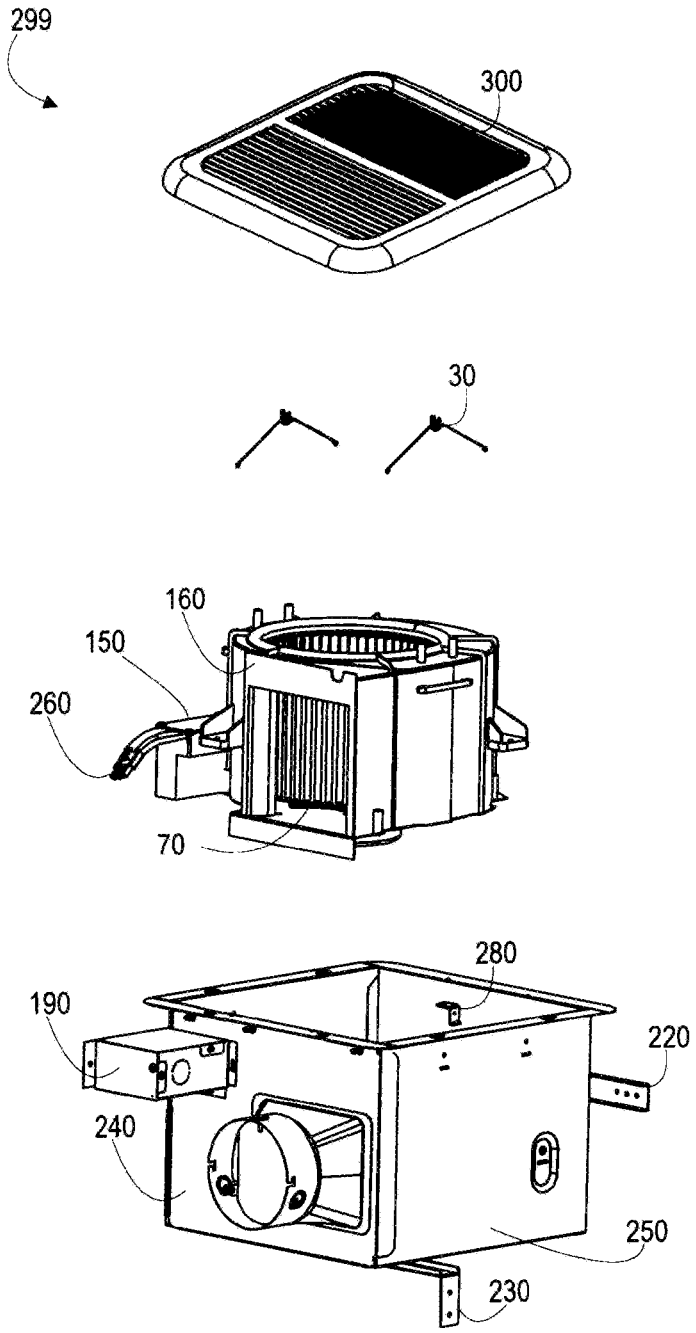
FIG. 12 is another exploded view of the bath fan of FIG. 11 with assembled blower housing separated from both the grill cover and main housing.
Figure 13:
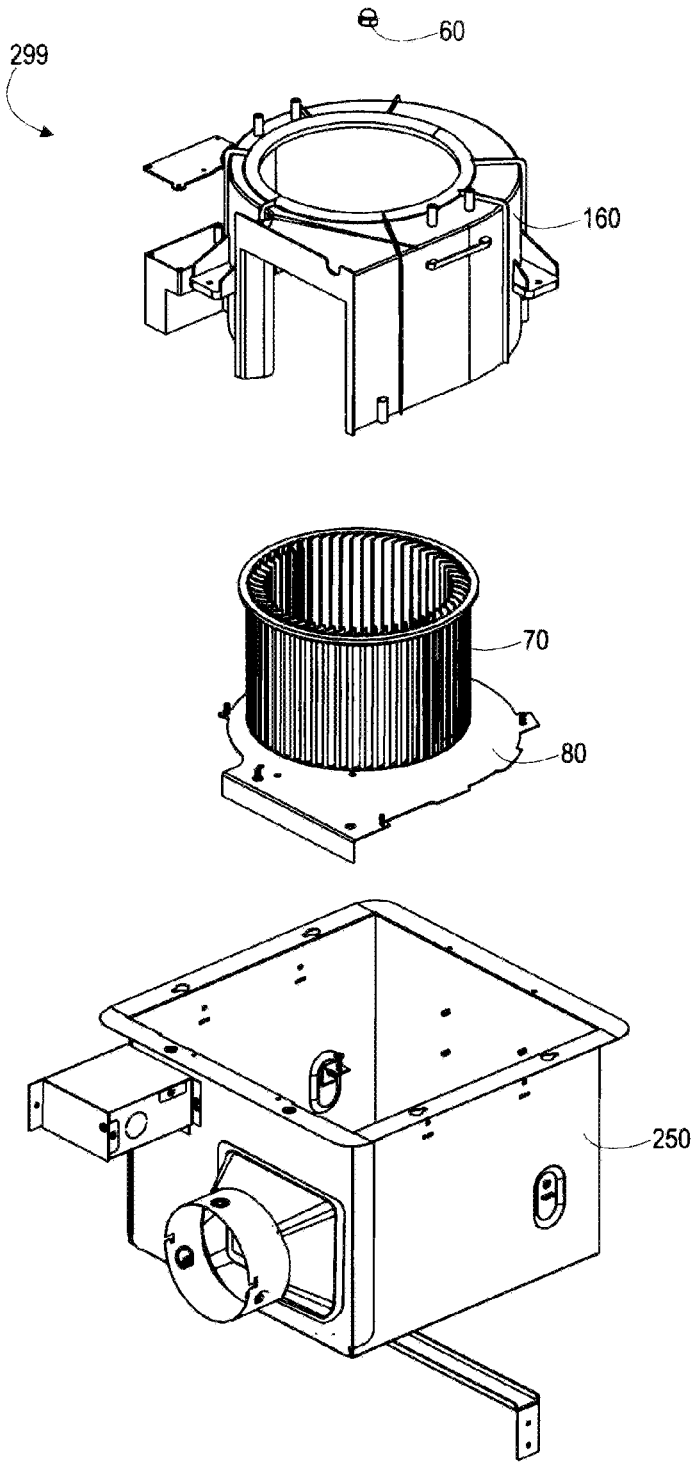
FIG. 13 is another exploded view of the bath fan of FIG. 11 with blower out of blower housing separated from the main housing.
Figure 14:
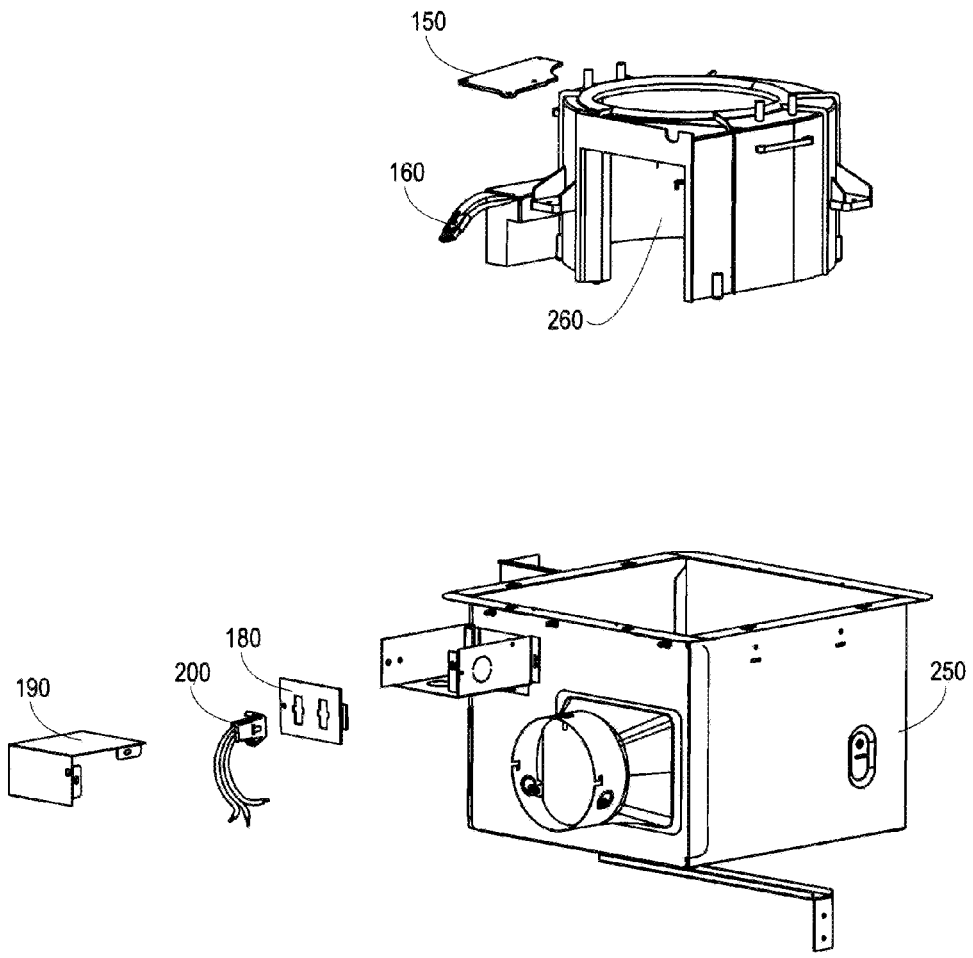
FIG. 14 is another exploded view of the bath fan of FIG. 11 with blower housing separated from main housing.

FIG. 11 is an exploded view of another 110 CFM bath fan (with no heater) 299 and with a grill cover 300 having no lightshade, such as shown in the previous figures. FIG. 12 is another exploded view of the bath fan 299 of FIG. 11 with assembled blower housing 250 separated from both the grill cover 300 and main housing 250. FIG. 13 is another exploded view of the bath fan 299 of FIG. 11 with blower 70 out of blower housing 160 separated from the main housing 250. FIG. 14 is another exploded view of the bath fan 299 of FIG. 11 with blower housing 160 separated from main housing 250.

Figure 15:
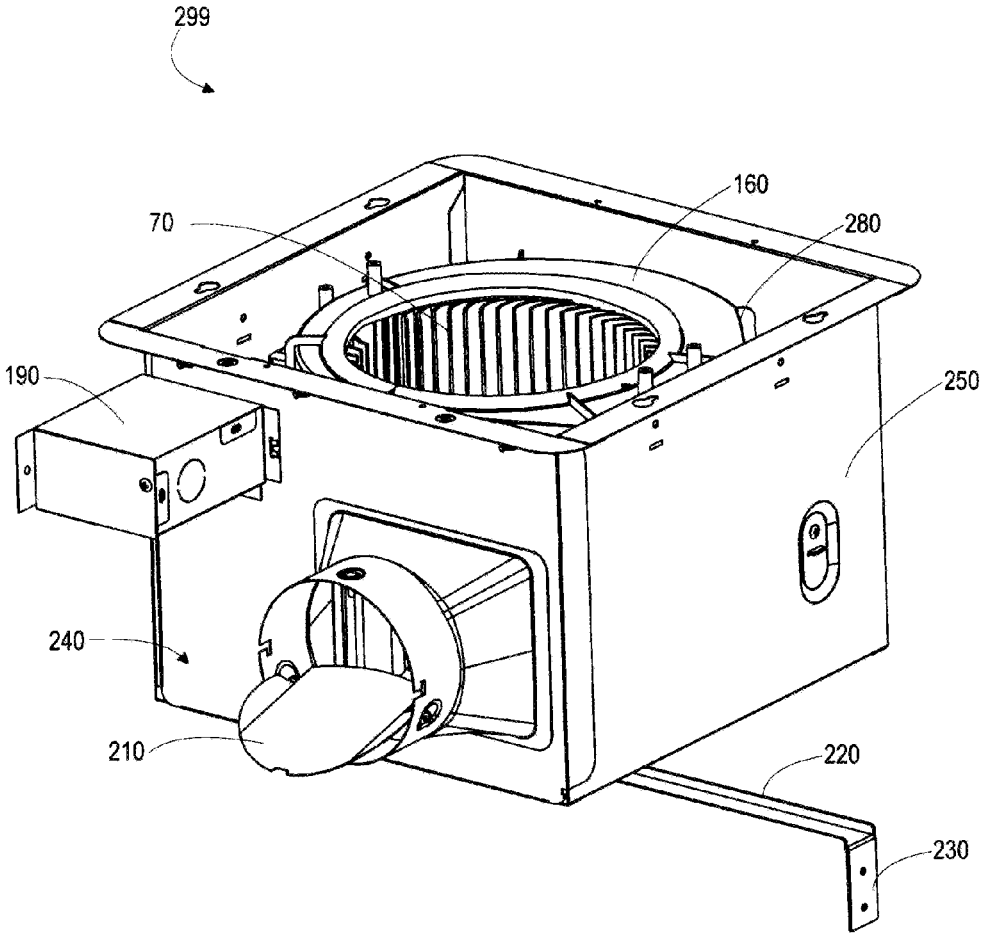
FIG. 15 is a perspective view of the bath fan of FIG. 11 assembled with blower housing components without the grill cover.
Figure 16:
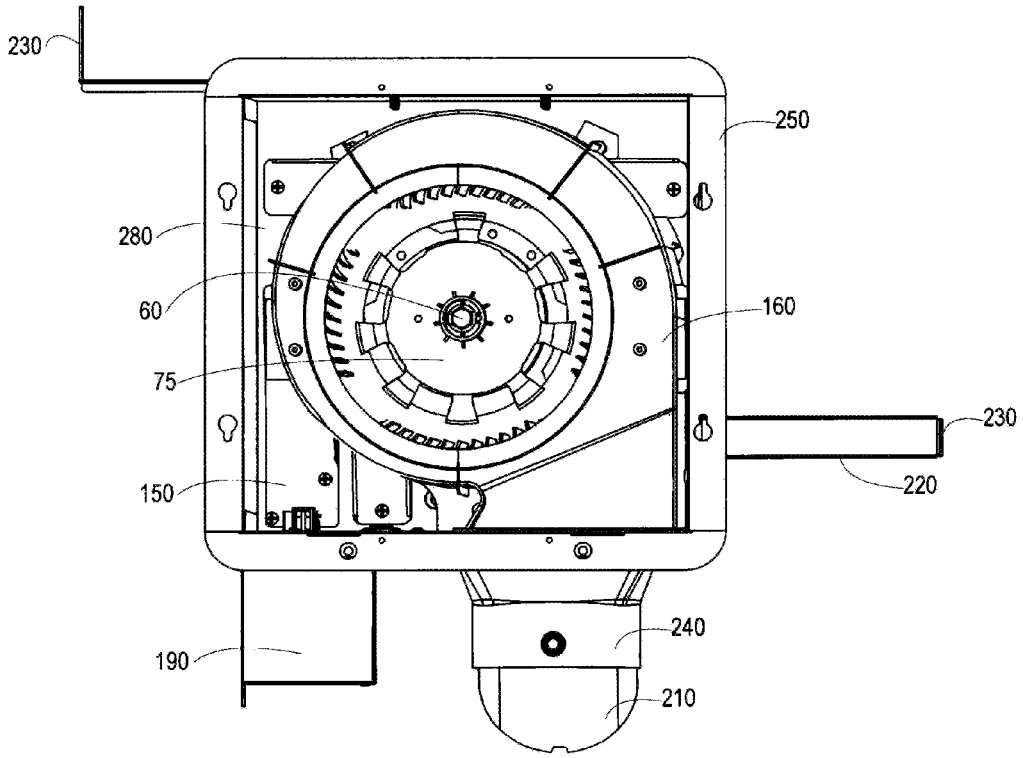
FIG. 16 is a top view of the bath fan of FIG. 15.
Figure 17:
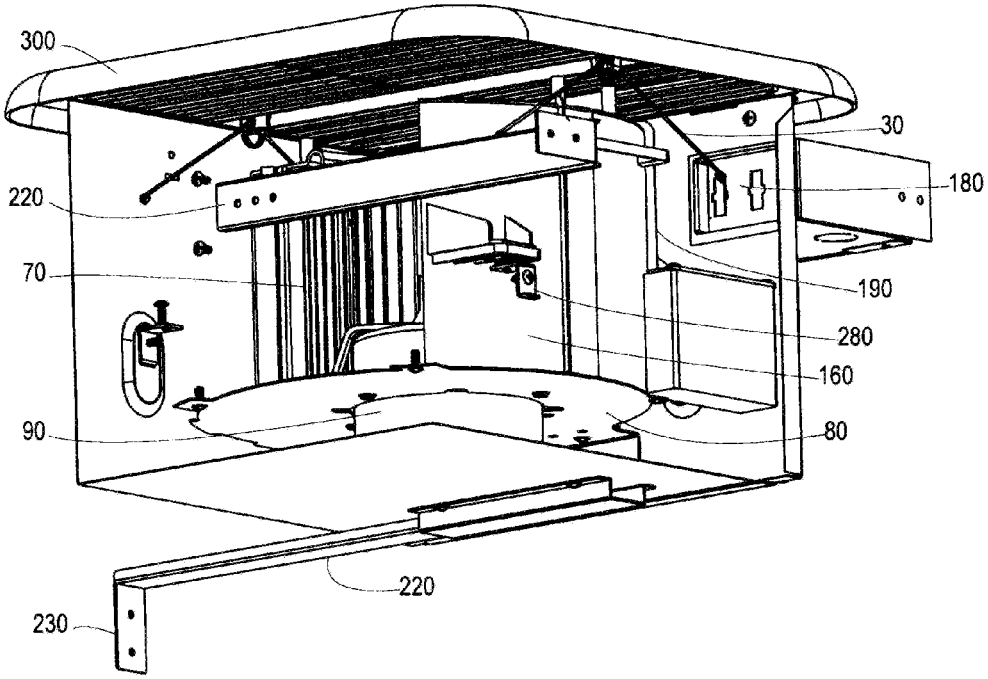
FIG. 17 is a perspective side view of the assembled bath fan of FIG. 11 having the grill cover and with partial cutout of portion of main housing.

FIG. 15 is a perspective view of the bath fan of FIG. 11 assembled with blower housing 250 components without the grill cover 300. FIG. 16 is a top view of the bath fan 299 of FIG. 15. FIG. 17 is a perspective side view of the assembled bath fan 299 of FIG. 11 having the grill cover 300 and with partial cutout of portion of main housing 250.

Figure 18A:
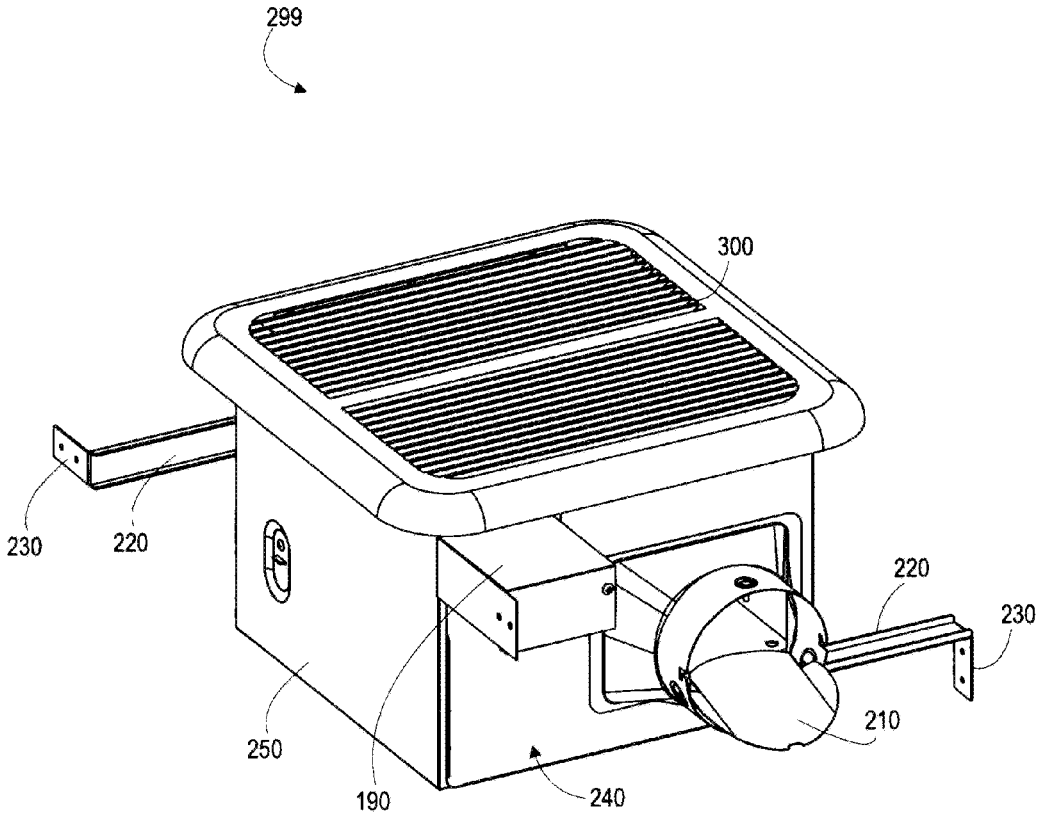
FIG. 18A is another perspective side view of the assembled bath fan of FIG. 17.
Figure 18B:
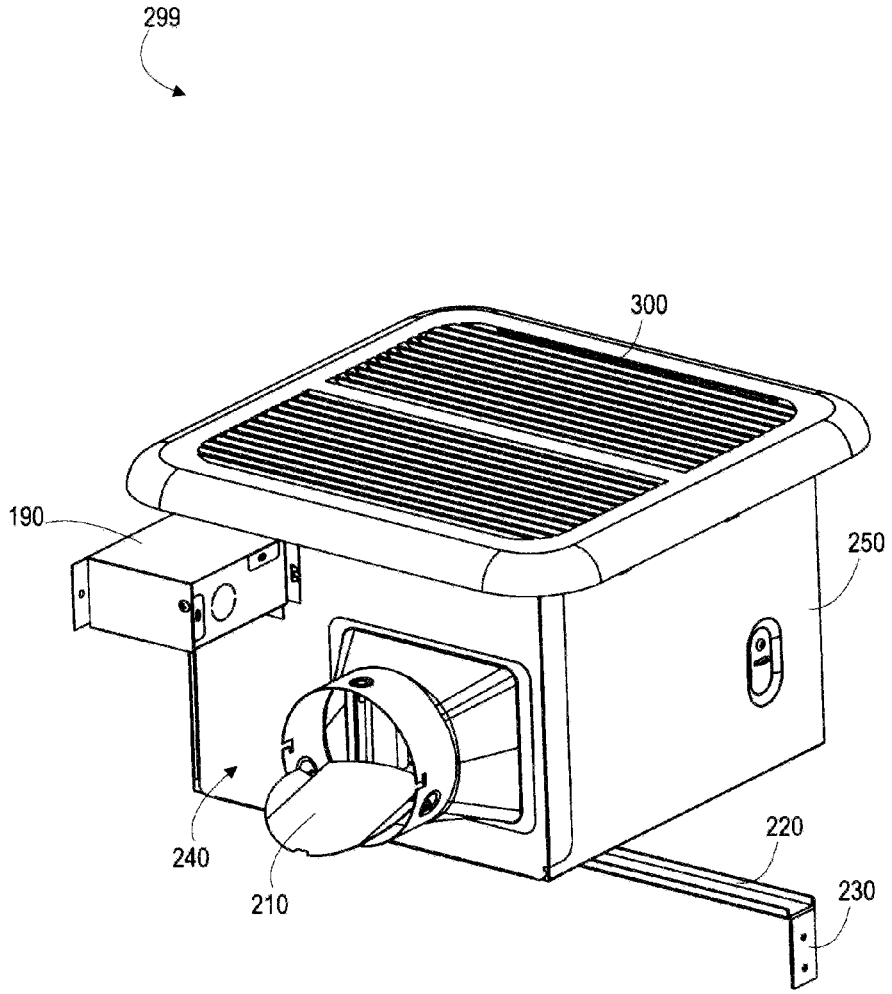
FIG. 18B is still another perspective side view of the assembled bath fan of FIG. 17.
Figure 19:
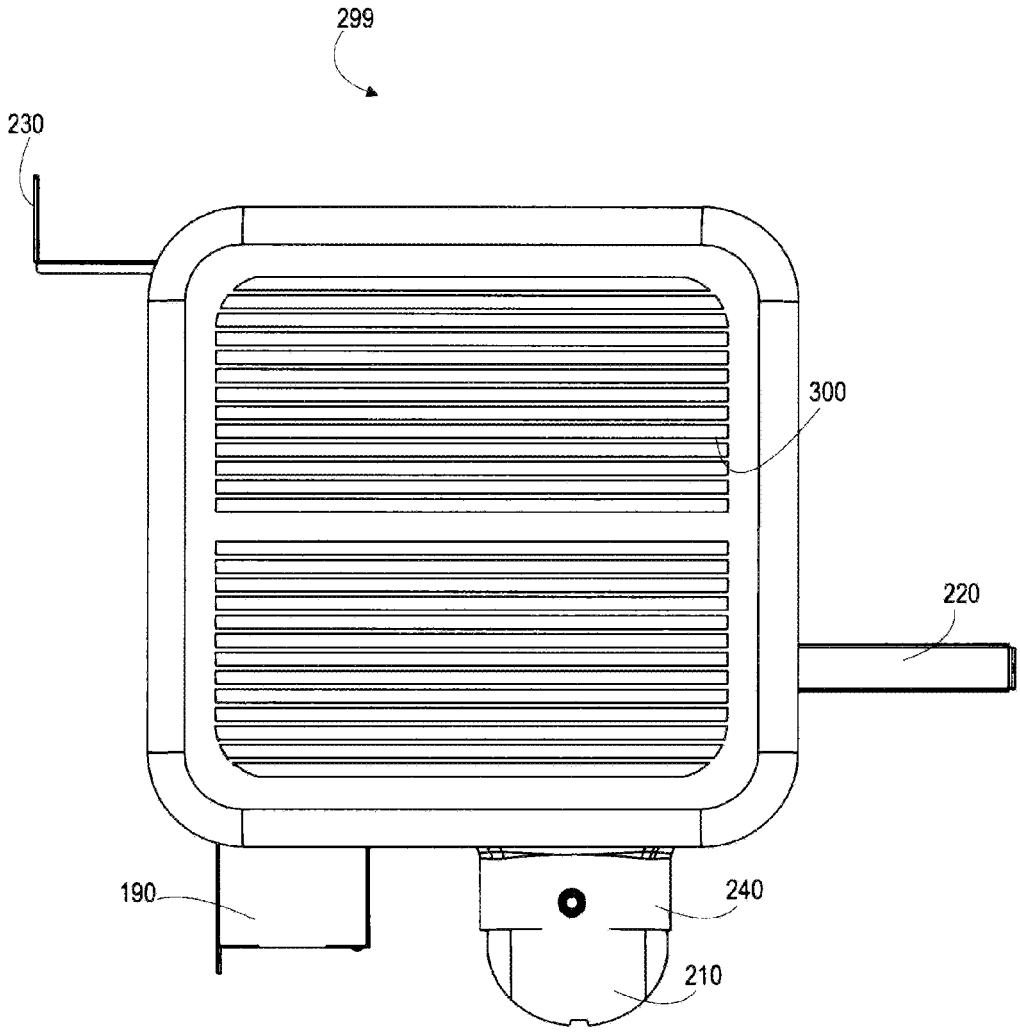
FIG. 19 is a top view of the assembled bath fan of FIGS. 18A-18B.

FIG. 18A is another perspective side view of the assembled bath fan 299 of FIG. 17. FIG. 18B is still another perspective side view of the assembled bath fan 299 of FIG. 17. FIG. 19 is a top view of the assembled bath fan 299 of FIGS. 18A-18B.

Referring to FIGS. 11-19, the bath fan 299 has similar components to the bath fan 1 shown and described in relation to FIGS. 1-10, with the exception of not having light cover 10.

Figure 20:
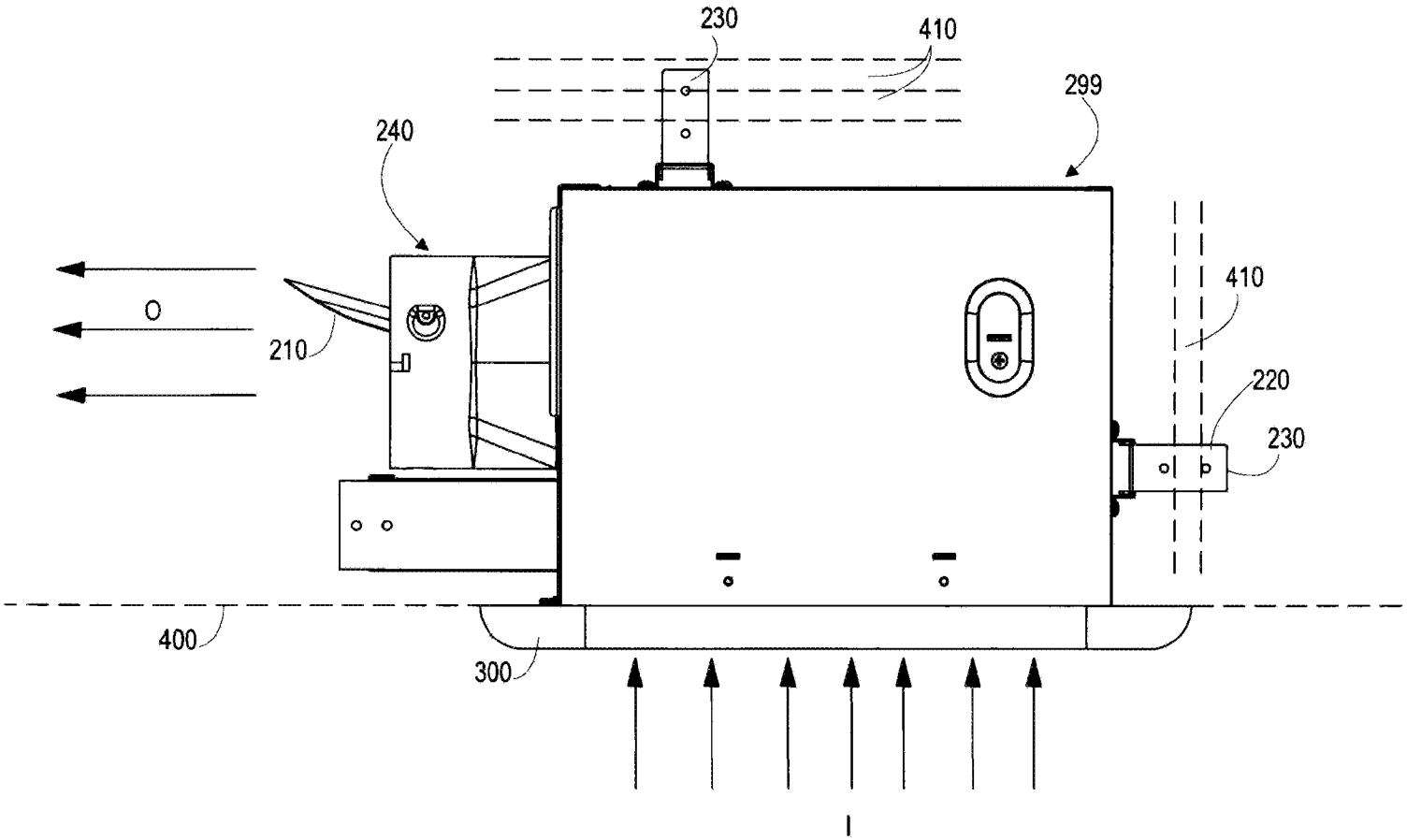
FIG. 20 shows the bath fan of FIGS. 11-19 in a working upright position attached to joists within a ceiling with arrows showing airflow intake and exhaust.

FIG. 20 shows the bath fan 299 of FIGS. 11-19 in a working upright position with the grill cover 300 flush mounted against a ceiling 400 attached to joists 410 within a ceiling with arrows showing airflow intake I into the vents in the grill cover 300 and air passes to exhaust out of the housing outlet 240 through a damper 210 in the direction of arrows labeled O. The first embodiment 1, described in relation to FIGS. 1-10 can attach to joists 410 in a similar manner and function in a similar manner to this embodiment.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A ventilation exhaust fan, comprising:

a one-piece housing having closed top, side walls and open bottom, the housing adapted to be mounted to a ceiling with the closed top and open bottom being parallel to the ceiling, the closed top having an opening therethrough;

a blower wheel inside of the housing, the blower wheel having a rotational axis mounted perpendicular to the top of the housing;

a motor mount board having an opening therethrough, the motor mount board having a bent side edge with an outer edge being directly attached to pass through the opening in the closed top of the housing;

a 110 CFM generating motor having top, bottom, side walls, and protruding flange edges on the sidewalls substantially midway between the top and the bottom, the protruding flange edges being attached to edge portions about the opening in the motor mount board so that the motor has a lower portion partially inside of the blower wheel, and an upper portion above the blower wheel, such that the motor mount board is located substantially at a midway point on the sidewalls of the motor; and a flush mounted grill cover, wherein air enters into the housing through openings in the grill cover, and is exhausted by the motor run blower.

2. The ventilation exhaust fan of claim 1, further comprising:

an outlet power box with removable cover, the box being attached to an external side wall outside of the housing.

3. The ventilating exhaust fan of claim 1, further comprising:

a first elongated side suspension bracket directly mounted along a bottom wall of the housing.

4. The ventilating exhaust fan of claim 3, further comprising:

a second elongated side suspension bracket directly mounted along a side wall of the housing, the side wall being perpendicular to the bottom wall, the second elongated side suspension bracket being substantially identical in length to the first elongated side suspension bracket.

5. The ventilating exhaust fan of claim 4, wherein the first suspension bracket has one end with a bent mounting flange, and the second suspension bracket has one end with a bent mounting flange, wherein the bent mounting flange on the first suspension bracket faces toward one side direction of the housing, and the bent flange on the second suspension bracket faces toward an opposite side direction of the housing.

6. The ventilating exhaust fan of claim 1, further comprising:

a light box supporting a light source beneath a lens cover, and vent openings about a perimeter edge of the lens cover, wherein incoming air passes through the vent openings to pass into the fan and not passing to the light sources inside of the light box.

7. The ventilating exhaust fan of claim 1, further comprising:

spring loaded washers for attaching the grill cover to the housing, without the use of any other fasteners.

8. The ventilating exhaust fan of claim 1, wherein the housing further includes: key hole slots for allowing the housing to be directly attached to enlarged headed fasteners adjacent to a ceiling.

9. A ventilation exhaust fan, comprising:

a one-piece housing having closed top, side walls and open bottom, the housing adapted to be mounted to a ceiling with the closed top and open bottom being parallel to the ceiling, the closed top having an opening therethrough;

a blower wheel inside of the housing, the blower wheel having a rotational axis mounted perpendicular to the top of the housing;

a motor mount board having an opening therethrough, the motor mount board having a bent side edge with an outer edge being directly attached to pass through the opening in the top of the housing;

a motor for operating the blower wheel, the motor having top, bottom, sidewalls and protruding flange edges on the sidewalls substantially midway between the top and the bottom, the protruding flange edges being attached to edge portions about the opening in the motor mount board so that a lower portion of the motor is partially inside of the blower wheel and an upper portion located above the blower wheel, and the motor mount board is located substantially at a midway point on the sidewalls of the motor;

a grill cover, wherein air enters into the housing through openings in the grill cover, and is exhausted therefrom by the motor run blower;

a first elongated side suspension bracket directly mounted along a bottom wall of the housing; and a second elongated side suspension bracket directly mounted along a side wall of the housing, the side wall being perpendicular to the bottom wall, the second elongated side suspension bracket being substantially identical in length to the first elongated side suspension bracket.

10. The ventilating exhaust fan of claim 9, further comprising:

a light box supporting a light source beneath a lens cover, and vent openings about a perimeter edge of the lens cover, wherein incoming air passes through the vent openings to pass into the fan and not passing into the light box.

11. The ventilating exhaust fan of claim 9, further comprising:

spring loaded washers for attaching the grill cover to the housing, without the use of any other fasteners.

12. The ventilating exhaust fan of claim 9, wherein the housing further includes: key hole slots for allowing the housing to be directly attached to enlarged headed fasteners adjacent to a ceiling.

13. A ventilation exhaust fan, comprising:

a housing having top, side walls and open bottom, the housing adapted to be mounted to a ceiling with the closed top and open bottom being parallel to the ceiling, the closed top having an opening therethrough;

a blower wheel inside of the housing, the blower wheel having a rotational axis mounted perpendicular to the top of the housing;

a motor mount having an opening therethrough, the motor mount having a bent side edge with an outer edge being directly attached to pass through the opening in the top of the housing;

a motor for operating the blower wheel, the motor having top, bottom, sidewalls and protruding flange edges on the sidewalls substantially midway between the top and the bottom of the motor, the protruding flange edges being attached to edge portions about the opening in the motor mount so that the motor has a lower portion partially inside of the blower wheel, and an upper portion above the blower wheel, and the motor mount is located substantially at a midway point on the sidewalls of the motor; and a grill cover over the open bottom of the housing, wherein air enters into the housing through openings in the grill cover, and is exhausted by the motor run blower.

* * * * *